United States Patent [19]

Shen

[11] Patent Number: 4,861,955

[45] Date of Patent: Aug. 29, 1989

[54] MATCHED ABSORPTIVE END CHOKE FOR MICROWAVE APPLICATORS

[76] Inventor: Zhi-Yuan Shen, Universal Exect. P.O. Box 2365, Darien, Conn. 06820

[21] Appl. No.: 71,413

[22] Filed: Jul. 9, 1987

[51] Int. Cl.[4] ..... H05B 6/76

[52] U.S. Cl. ..... 219/10.55 D; 219/10.55 A; 174/35 R

[58] Field of Search ..... 219/10.55 D, 10.55 A, 219/10.55 R; 174/35 R, 35 MS

[56] References Cited

U.S. PATENT DOCUMENTS

| | | | |
|---|---|---|---|
| 3,365,562 | 1/1968 | Jeppson | 219/10.55 A |
| 3,624,335 | 11/1971 | Dench | 219/10.55 D |
| 3,858,022 | 12/1974 | Smith | 219/10.55 A |
| 3,909,574 | 9/1975 | Muller et al. | 219/10.55 A |
| 4,319,856 | 3/1982 | Jeppson | 219/10.55 A |
| 4,488,027 | 12/1984 | Dudley et al. | 219/10.55 A |
| 4,570,045 | 2/1986 | Jeppson | 219/10.55 D |

*Primary Examiner*—Philip H. Leung
*Attorney, Agent, or Firm*—Ronald Snider

[57] ABSTRACT

A microwave application chamber including a reactive and absorptive choke is shown and described. The absorptive choke is made of a material having the same or close dielectric constant as the material being treated so that microwave energy will pass readily from the material being treated into the absorptive choke. The interface between the absorptive choke and the material being treated is essentially transparent to microwave without reflections. This transparency permits microwave energy to be absorbed in the absorptive choke which otherwise would follow the waveguide created by the material being treated and exit into the environment.

27 Claims, 2 Drawing Sheets

FIG. 1
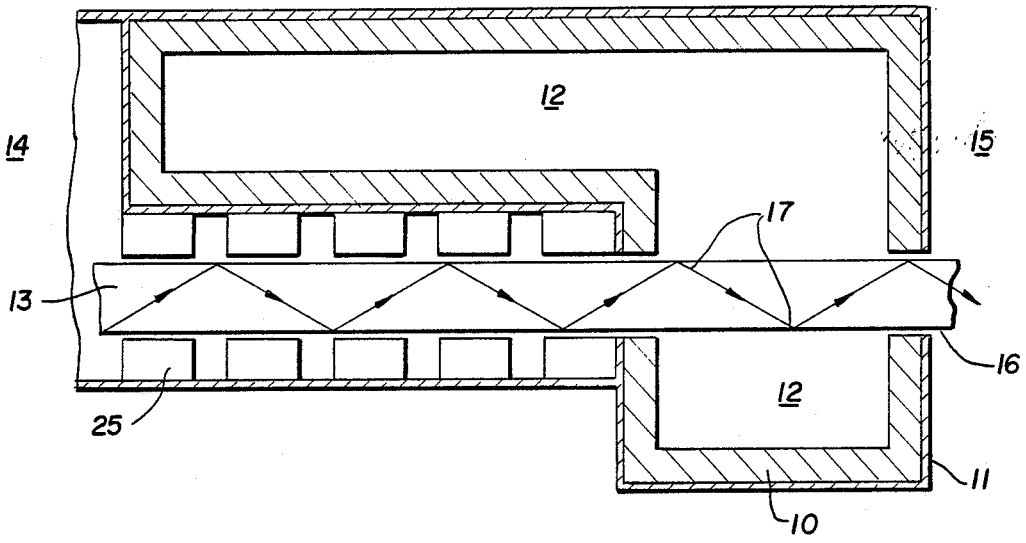
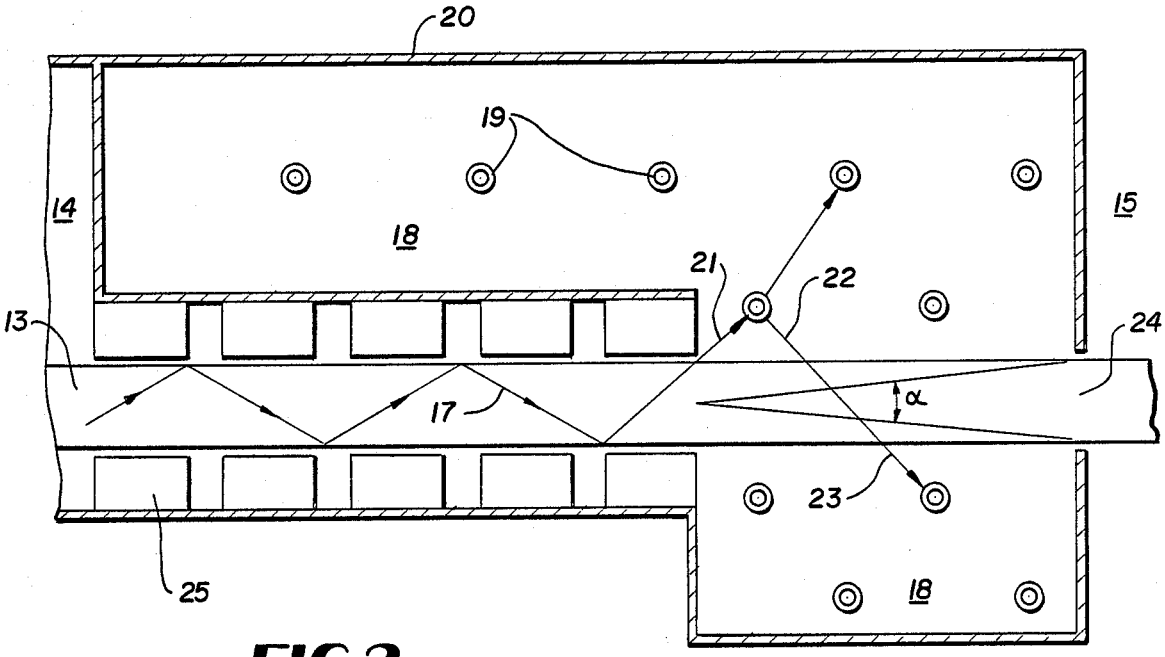
FIG. 2

MATCHED ABSORPTIVE END CHOKE FOR MICROWAVE APPLICATORS

TECHNICAL FIELD

This invention relates to the field of microwave heating of materials which are passed through a microwave applicator by means of a conveyor belt. This invention prevents significant leakage of microwave radiation into the environment.

BACKGROUND OF THE INVENTION

The use of conveyor belts to transport material into a microwave applicator is well known in the art. It is also well known that the leakage of microwave energy out from the oven or applicator and into the surrounding environment is highly undesirable. Any significant amount of leakage can cause injury to persons in the region where the microwave energy escapes, and can cause interference to microwave communication and aviation systems. Therefore, it is necessary in all said applications to provide a reliable means for controlling the microwave energy and to provide safety features which will prevent injury to humans or other equipment in the region.

A conveyor necessarily requires that the microwave application region have openings in order to provide for entrance and exit of the conveyor belt.

The material on the conveyor belt will itself form a waveguide because of its different dielectric constant with respect to the conveyor belt or air which surrounds it. Therefore, the material passing into and out of the application region of a microwave heater becomes a waveguide and forms a path for escape of microwave energy into the surrounding environment.

U.S. Pat. No. 4,570,045 to Jeppson shows the use of a microwave heating chamber wherein the containment walls of the chamber are constructed of a dielectric material. The dielectric material, when used as a containment for the heating chamber, absorbs a significant amount of the energy that would otherwise be available for the heating of materials. In FIG. 3 Jeppson discloses the use of an absorptive material surrounding the conveyor as it enters or exits the heating chamber. This use in the immediate entrance to the heating chamber also consumes substantial amounts of microwave energy that could otherwise be utilized for heating of the product on the conveyor belt. Jeppson does not disclose the use of a reactive element in combination with the absorptive material. Jeppson also fails to disclose any relationship between the substance being heated 16 and the material of the absorptive choke which surrounds the conveyor openings as well as the entire heating chamber.

U.S. Pat. No. 4,488,027 to Dudley et al. (hereinafter Dudley) shows the use of a choke tunnel which has a high impedance to microwave energy at the operating frequency. The first tunnel portion 16 is metallic and operates as a reactive choke which causes the microwave energy to bounce back to the applicator and into the material being treated, and not absorbed by the choke. This section of the Dudley choke conserves energy by redirecting it back to the applicator and into the material being treated. Dudley also points out that this section is primarily efficient at the designed frequency and has little beneficial effect at the harmonic frequencies of the fundamental frequency of the microwave treatment device.

Attached to the metallic tunnel 16 is a second tunnel 18 which is also made of metal but in addition includes a thermomagnetic layer along its inner surfaces which will absorb microwave energy. This second region 18 is used to absorb the microwave radiation that leaks from the first all metallic reactive region.

Neither Dudley nor Jeppson discloses any relationship between the absorptive material and the materials being treated by the microwave applicator or oven. However, if the dielectric constant of the materials being treated is different from that of the surrounding areas, partial or total reflections of microwave power occurs at the interface, which causes the material layer above the conveyor to act as a dielectric waveguide. This waveguide effect confines the microwave within the material layer and allows the microwave to propagate through the absorptive choke without significant attenuation which causes substantial leakage of microwave energy out of the desired containment region and into the environment where humans may be injured, or interference with communications may occur. The Jeppson and Dudley patents fail to disclose any relationship between the dielectric constants of the material being treated and the surrounding material used for the absorptive choke. This is the main reason for the ineffectiveness of Jeppson's and Dudley's choke to prevent leakage.

BRIEF SUMMARY OF THE INVENTION

This invention is directed to a microwave applicator or oven for treatment of high dielectric constant materials such as recyclable asphalt pavement (RAP). It has been found that conventional methods of choking or controlling the leakage from the microwave applicator chamber are inefficient or ineffective at best. The reason is that the high dielectric constant materials such as RAP may be as thick as 6 inches and substantially covering the conveyor belt. In this situation the high dielectric constant materials, such as RAP, act as a waveguide, and transmit the energy from the applicator region out into the environment.

It has been found that an effective microwave containment absorptive choke may be designed wherein the material of the choke has the same or close dielectric constant as the material being treated in the applicator. The space between the absorptive choke and the material being treated on the belt should be kept as small as possible so that the microwave energy will pass freely from the material being treated into the choke. When this occurs, the path for the microwaves extends into the choke and the choke absorbs the microwave energy which would otherwise be transmitted along the waveguide defined by the material being treated. This invention also utilizes a reactive choke located between the absorptive choke and the microwave application chamber. The reactive choke operates in cooperation with the absorptive choke to provide the most efficient use of microwave energy. The reactive choke will reflect microwave energy back to the applicator and into the material being treated and thus will not lose the microwave energy by inserting it into an absorptive choke.

This invention provides an efficient and inexpensive absorption section which will stop the leakage from the large opening through which the high dielectric constant materials such as RAP must pass. The match of the dielectric constant of the material used in the choke with the dielectric constant of the product extracts the microwave trapped in the product layer. The microwaves which extend on into the absorptive choke are dissipated when energy is converted to heat which may be taken off by means of the circulating coolant in the cooling tubes. In this arrangement the interface between the product layer and the absorptive chamber disappears electrically; and therefore, the entire media (the material being treated and the absorptive choke) acts as a whole. The undesirable waveguide effect disappears. This reduces leakage significantly. The attenuation provided by the absorptive matched dielectric choke can be estimated by the following formula:

$$a = 10 \log \frac{180°}{\alpha°} \text{ dB}$$

where $\alpha o$ is the span angle of the opening as seen from the end of the choke where the product passes. The span angle $\alpha$ is shown on FIG. 2 of the drawings.

BRIEF DESCRIPTION OF THE DRAWINGS

FIG. 1 shows a conventional choke arrangement for preventing leakage of microwave energy where material is passed through a microwave applicator on a conveyor belt.

FIG. 2 shows the absorptive choke and reactive choke in accordance wit h this invention.

DETAILED DESCRIPTION OF THE INVENTION

Figure 3:
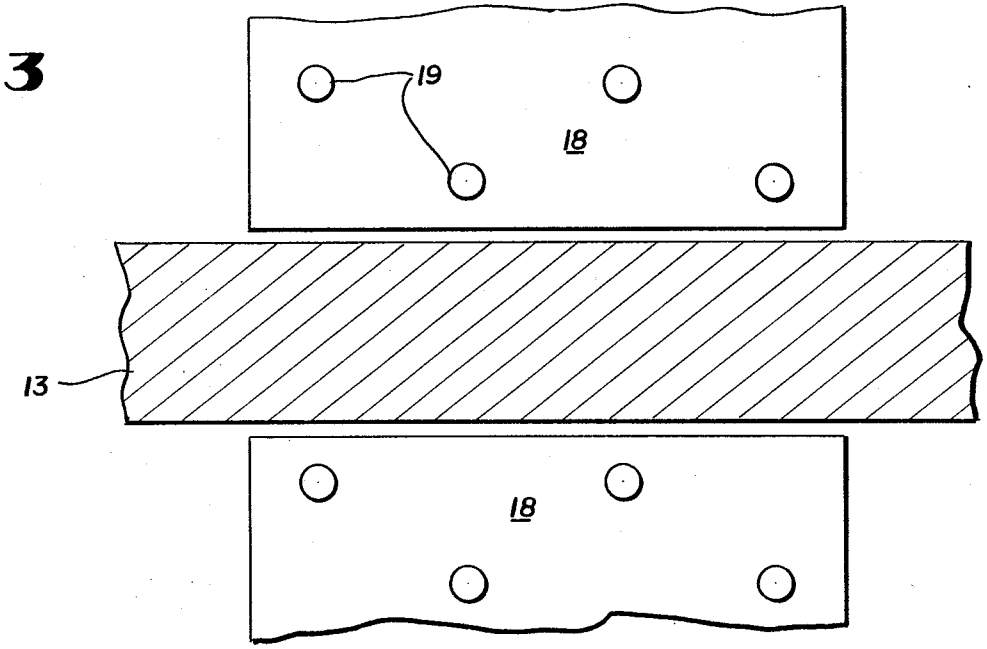
FIG. 3 shows an expanded view of the absorptive section of the absorptive choke with the conveyor loaded with material which is being treated.

FIG. 1 shows the prior art absorptive chamber which is a metallic shell 11 lined with an absorptive material 10. This design is similar to that of Dudley because it includes the absorptive coating over the top of the metallic frame and structure. The absorptive coating 10 over the metallic frame 11 provides an absorptive lining for chamber 12 which receives microwave energy which escapes from the product 13. Some of the microwave energy is prevented from escaping from the microwave oven 14 and into the region of the environment 15. In this configuration the product on top of the conveyor 16 acts as a waveguide as the material extends through the opening chamber 12. Air has a different dielectric constant than the material being treated. The material being treated acts as a waveguide when microwave energy is bounced off its surfaces and back into the material. The waves therefore move along the material and into the environment 15. The bounce of the microwave energy is generally depicted as 17 (the zigzag path passing through the material 13).

In applicant's invention, FIG. 2, the absorptive material is selected so that its dielectric constant matches that of the material being treated 13. The selected matching material 18 may be constructed of cement, cement filled with ferrites, rubber containing ferrites, or any other combination of materials which will provide the same or close dielectric constant as the material being treated. In some instances, the absorptive material 18 may comprise the material being treated with the mere addition of a binder.

The absorptive choke material 18 may be interlaced with cooling passages 19 which remove excess heat from the choke. This is the excess heat produced by the microwave energy which is absorbed into the material of the choke. The choke is also surrounded on its outer surfaces by a metallic enclosure which will serve to reflect any extraneous microwave energy back into the absorbent material and prevent its loss into the environment.

In FIG. 2 the microwave paths are indicated by arrows. Escaped microwave energy from the reactive choke 25 enters the absorptive choke which is filled with the absorptive material 18 having the same or close dielectric constant as the product 13 being treated. Interface between the product 13 and the absorptive material 18 disappears electrically. No reflection occurs at the interface. The otherwise trapped microwave energy will escape from the product layer and dissipate in the absorptive choke. The generated heat will be carried away by circulating coolants in the tube 19. FIG. 2 shows a typical zig-zagged microwave path which comes out from the reactive choke, passes through the interface, and strikes on a cooling tube. Part of the microwave energy is absorbed by water inside the tube; the other part reenters the absorptive material 18 and eventually dissipates either in the absorptive material 18 or in the water in other tubes.

FIG. 2 also illustrates the span angle $\alpha$ which is the angle generated between lines adjoining the absorptive choke outlet and the center of the absorptive choke inlet. As the choke is extended along the length of the belt carrying material 13, the angle will obviously decrease. The span angle $\alpha$ is used to determine the attenuation of the energy which escapes at the opening 24 and into the environment 15.

The coolant tubes 19 may be constructed in any one of several ways. The tubes may be a mere hose laced through the absorptive choke material, or may be tubing made of any material transparent to microwave such as PVC, teflon or rubber. Coolant is passed through the tubes 19 to remove the excess heat from the absorptive choke region. Water may be selected because water will absorb microwave energy directly, and absorb energy which happen to strike the water itself.

In addition to the absorptive choke, FIGS. 1 and 2 show a reactive choke 25. This reactive choke provides for reflection of the microwave energy back to the applicator and into the material being treated. This is the most efficient means of handling the relatively high intensity energy at the immediate opening of the oven or applicator region 14. It is clearly more efficient to utilize this energy in heating the material treated 13 rather than to absorb it into material 18. The reactive choke may be a corrugated choke or doubly corrugated choke as described in "Doubly Corrugated Chokes for Microwave Heating Systems" by A. L. Van Koughnet and J. G. Dunn, *Journal of Microwave Power*, 8(1) 1973 at page 101. Another form of reactive choke is shown in U.S. Pat. No. 4,488,027 to Dudley et al. The Dudley choke includes, as shown in FIG. 2, a plurality of posts 30 which are sized in accordance with the wavelength of the primary source of microwave energy which comes from the applicator or microwave oven.

FIG. 3 shows a more detailed view of the material being treated 13 passing through the region of the reactive choke material 18 with cooling tubes 19. As shown the space between the material treated and the absorptive choke material is small so that the interface appears transparent to the microwave energy in the material treated. In the case of RAP (recycled asphalt pavement), the depth of the rap can be as deep as 6 inches where the frequency is 915 Mhz.

Figure 4:
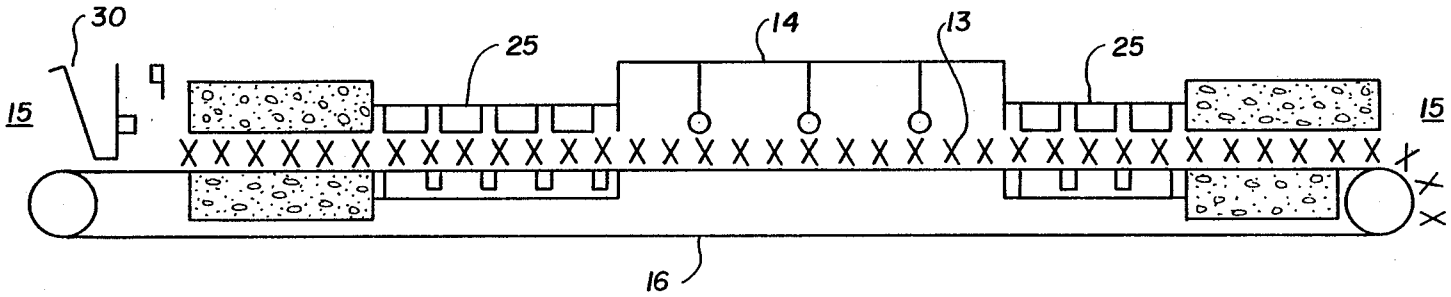
FIG. 4 depicts an entire assembly of a microwave treatment facility including the absorptive choke, the reactive choke, and the main applicator section.

FIG. 4 shows a microwave heating region 14 through which a conveyor 16 passes. The reactive chokes 25 are shown at the inlet and outlet of the treatment region 14. Attached to each reactive choke 14 is an absorptive choke in accordance with this invention which provides for the final capture of microwave energy. The absorptive chokes prevent energy from entering into the environment 15. There is also shown a hopper 30 which is used to place the material treated 13 on the belt 16.

It has been found that use of a reactive choke alone is insufficient to provide adequate attenuation of microwave energy which would be emitted through a wide opening for high dielectric constant materials such as a 6-inch layer of RAP passing through a microwave applicator or oven. The opening for a 6-inch layer passing through a choke is much larger than the maximum value which can be used with only a reactive choke. For this reason, an effective absorptive choke is needed for reducing the leakage of microwave energy to an acceptable level in this application.

The absorptive material 18 may be constructed with concrete containing aggregate having a dielectric material which has the same or close dielectric constant as the material carried on the conveyor. The construction of the concrete absorptive choke may be of poured concrete in a metallic enclosure or frame 20, as depicted in FIG. 2. In the case of RAP, it may be used as the filler for the concrete. It is also possible to utilize a ferrite loader rubber, so long as the composition exhibits the overall dielectric constant which matches that of the asphaltic material being treated.

The cooling tubes 19 may be constructed of any material transparent to microwave such as PVC, teflon, rubber, etc., which will permit the passage of water. As can be seen in FIGS. 2 and 3, this invention also envisions placement of the absorptive material both above and below the conveyor belt 16 carrying the material to be treated such as RAP 13. Obviously, absorbent material should also be placed on the sides of the absorptive choke region to prevent lateral escape of microwave energy into the environment. In order to utilize the full effect of the absorbent material underneath the conveyor belt, it is also necessary that the conveyor belt be constructed of a material which is transparent to microwave radiation. In this manner, the belt does not interfere with the absorption of the energy by that portion of the absorptive material 18 located below the belt.

In case a metallic conveyor belt is used, the absorptive and reactive choke elements below the conveyor are not necessary. However, the absorptive and reactive choke elements above and on both sides are necessary as previously described.

The structure of this invention and the method of treatment of materials is not to be limited by the above-described embodiments, but may be modified in a variety of ways without departing from the spirit of this invention.

I claim:

1. A tunnel microwave applicator comprising in combination:

material in said tunnel which is treated with microwaves;

a microwave generator in said tunnel;

a conveyor belt extending through an opening in said applicator; a concrete absorptive choke surrounding said conveyor at said opening in said applicator; and said absorptive choke having a dielectric constant which prevents the wave guide effect in said material on said conveyor and allows microwave energy to pass into said choke material.

2. The tunnel microwave applicator of claim 1, further comprising an absorptive choke which includes passages through which a coolant is passed.

3. The tunnel microwave applicator of claim 2, wherein the coolant is water.

4. A microwave applicator of claim 1 wherein said dielectric constant of said choke material is the same as the dielectric constant as said material being treated.

5. A microwave applicator of claim 1 wherein said dielectric constant of said choke material is close enough to the dielectric constant of said material being treated that all microwaves in said material being treated pass into said choke material and are absorbed therein.

6. A microwave applicator of claim 1 wherein said dielectric constant of said choke material is close enough to the dielectric constant of said material being treated that the electrical interface between said material being treated and said choke material disappears.

7. A microwave applicator of claim 1 wherein said dielectric constant of said choke material is close enough to the dielectric constant of said material being treated that there is no reflection of microwaves from said choke material.

8. The microwave applicator of claim 1 wherein said choke material closely surrounds said conveyor belt.

9. A microwave applicator of claim 1 wherein said dielectric constant of said choke material is close enough to the dielectric constant of said material being treated that there is no reflection of the microwaves at the interface of said material being treated and said choke material.

10. A microwave application of claim 1 wherein said absorptive choke attenuation is estimated by the following formula:

$$a = 10 \log 180 \text{ dB}$$

where is the span angle of the opening as seen from the end of the choke where the product passes.

11. A tunnel microwave applicator comprising in combination:

a microwave generator in said tunnel;

material in said tunnel which is treated with microwaves;

a conveyor belt extending through an opening of said applicator;

a reactive choke at said conveyor opening of said applicator for reflecting microwave radiation back to the applicator and into material on said conveyor, said reactive choke having a first end connected to said microwave applicator and having a second end; and an absorptive choke connected to said second end of said reactive choke, wherein said absorptive choke is constructed of a material having a dielectric constant which prevents the wave guide effect in said material on said conveyor and allows microwave energy to pass into said choke material.

12. A tunnel microwave applicator in accordance with claim 11, wherein said material on said conveyor is the same material as said absorptive choke.

13. A tunnel microwave applicator in accordance with claim 1, wherein coolant is passed through tubes in said absorptive choke for dissipating and removing excess heat.

14. A tunnel microwave applicator in accordance with claim 13, wherein the coolant is water.

15. A tunnel microwave applicator in accordance with claim 13, wherein said cooling tubes are constructed of any material which is transparent to microwaves.

16. A tunnel microwave applicator in accordance with claim 12, wherein said absorptive choke is constructed of concrete containing aggregate having a dielectric material which has the same or close dielectric constant as the material carried on said conveyor.

17. A tunnel microwave applicator in accordance with claim 16, wherein said absorptive choke is constructed by pouring concrete around hoses placed in said concrete.

18. A tunnel microwave applicator in accordance with claim 16, wherein said absorptive material is a ferrite loaded rubber.

19. A tunnel microwave applicator in accordance with claim 11, wherein said absorptive choke is water cooled.

20. A tunnel microwave applicator in accordance with claim 11, wherein said absorptive choke is enclosed in a metallic enclosure.

21. A tunnel microwave applicator in accordance with claim 11, wherein said reactive choke is enclosed in a metallic enclosure.

22. A tunnel microwave applicator in accordance with claim 11, wherein said conveyor belt carries high dielectric constant materials such as having a depth of more than half wavelength in the material.

23. A tunnel microwave applicator in accordance with claim 11, wherein said absorptive choke is above, on both sides of, and below a non-metallic conveyor.

24. A tunnel microwave applicator in accordance with claim 11, wherein said absorptive choke is above, and on both sides of a metallic conveyor.

25. A tunnel microwave applicator in accordance with claim 7, wherein said reactive choke is a corrugated choke.

26. A tunnel microwave applicator in accordance with claim 11, wherein said reactive choke is a doubly corrugated choke.

27. The microwave applicator of claim 11 wherein said choke material closely surrounds said conveyor belt.

* * * * *